US007017619B2

(12) United States Patent
Bassi

(10) Patent No.: US 7,017,619 B2
(45) Date of Patent: Mar. 28, 2006

(54) SHED FORMING DEVICE AND WEAVING LOOM OF THE JACQUARD TYPE EQUIPPED WITH SUCH A DEVICE

(75) Inventor: Dario Bassi, Chaponnay (FR)

(73) Assignee: Staubli Lyon, Chassieu (FR)

( * ) Notice: Subject to any disclaimer, the term of this patent is extended or adjusted under 35 U.S.C. 154(b) by 105 days.

(21) Appl. No.: 10/838,321

(22) Filed: May 5, 2004

(65) Prior Publication Data

US 2004/0221911 A1 Nov. 11, 2004

(30) Foreign Application Priority Data

May 6, 2003 (FR) ..... 03 05505

(51) Int. Cl.
*D03C 3/00* (2006.01)

(52) U.S. Cl. ..... 139/59; 139/55.1

(58) Field of Classification Search ..... 139/59, 139/68, 65, 1 R, 71, 55.1, 62
See application file for complete search history.

(56) References Cited

U.S. PATENT DOCUMENTS 5,176,181 A 1/1993 Bassi
5,513,676 A * 5/1996 Speich ..... 139/65
5,570,724 A 11/1996 Bassi et al.
5,671,781 A * 9/1997 Palau ..... 139/59
5,927,347 A * 7/1999 Palau et al. ..... 139/65
6,463,962 B1 * 10/2002 Dewispelaere ..... 139/65

FOREIGN PATENT DOCUMENTS

| | | |
|---|---|---|
| EP | 0681042 | 11/1995 |
| FR | 2669650 | 5/1992 |
| FR | 2802219 | 6/2001 |
| GB | 2047755 A * | 12/1980 |

* cited by examiner

*Primary Examiner*—John J. Calvert
*Assistant Examiner*—Andrew W. Sutton
(74) *Attorney, Agent, or Firm*—Dowell & Dowell, P.C.

(57) ABSTRACT

The shed forming device according to the invention for a weaving loom of Jacquard type comprises two series of knives actuated by a single input shaft animated by a continuous movement of rotation and extending between two plates which support oscillating shafts equipped with rocking levers kinematically connected to the series of knives. The input shaft is equipped, in the vicinity of each plate, with means for driving the rocking levers. The oscillating shafts extend in parallel between the plates and are each connected to the input shaft by a single rod and eccentric link, a link being respectively made in the vicinity of each plate.

10 Claims, 2 Drawing Sheets

SHED FORMING DEVICE AND WEAVING LOOM OF THE JACQUARD TYPE EQUIPPED WITH SUCH A DEVICE

FIELD OF THE INVENTION

The present invention relates to a shed forming device and to a weaving loom of the Jacquard type equipped with such a device.

More particularly, it concerns the vertical actuation, in phase opposition, of the two series of blades or knives which, in a Jacquard type loom, ensure the vertical displacement of the hooks of a weave system.

BACKGROUND OF THE INVENTION

In such a loom, hooks disposed in rows are alternately raised by bars or blades commonly called "knives" or "griffes", these knives or griffes themselves most often being supported by one of the two griffe frames. Each frame must be animated by a vertical oscillatory movement in phase opposition with the other frame.

To that end, it is known from FR-A-2 669 650 to use an input shaft animated by a continuous movement of rotation and on which are mounted four eccentrics each associated with a connecting rod for controlling a rocking lever, the rocking levers being mounted, in groups of two, on shafts provided on each side of the frames. This kinematics is relatively complex and expensive, while it is delicate to adjust, particularly due to the high number of articulations resulting from the use of four eccentrics and four control rods. In addition, auxiliary frames or plates must be added on the frame of the loom in order to support, on the one hand, the input shaft and, on the other hand, the shafts on which the rocking levers are mounted.

It is a more particular object of the invention to overcome these drawbacks by proposing a novel, simplified shed forming device whose reliability is improved and which is easier to assemble and to adjust than the known devices.

SUMMARY OF THE INVENTION

To that end, the present invention relates to a shed forming device for a weaving loom of Jacquard type in which the alternating vertical actuation of two series of knives is effected from a single input shaft animated by a continuous movement of rotation and extending between two plates which support oscillating shafts equipped with rocking levers kinematically connected to the series of knives, this input shaft being equipped, in the vicinity of each plate, with means for driving the afore-mentioned rocking levers. This device is characterized in that the oscillating shafts extend in parallel at least between the plates and are each connected to the input shaft by a single rod and eccentric link, such a link being respectively made in the vicinity of each plate.

Thanks to the use of oscillating shafts extending between the support plates, the device of the invention requires only two rod and eccentric links, provided respectively on each side of the knives, i.e. in the vicinity of the plates, in order to drive these series of knives efficiently. In other words, the oscillating shafts which extend over the whole length of the knives transmit the drive couple of the rocking levers on the two sides of the knives, this allowing a unilateral control of the two rocking levers associated with each series of knives on each oscillating shaft.

A shed forming device may, in addition, incorporate one or more of the following characteristics:

- the oscillating shafts are superposed above the series of knives;
- the oscillating shafts are substantially identical;
- the input shaft and the oscillating shafts are supported by bearings mounted on the plates. In particular, it is not necessary to provide oil pans such as sometimes used in the devices incorporating cam systems. With respect to the cam systems, the rod and eccentric link makes it possible to use less precise ranges of machining, which is advantageous in terms of cost price. The afore-mentioned bearings are advantageously constituted by lubricated rollers;
- the plates are substantially identical;
- the input shaft is adapted to be connected to a drive shaft at the level of each of its ends, this making it possible to control the device by one side or by another, as a function of the exact type of loom on which it must be controlled.

According to possible forms of embodiment of the invention, the rods belonging respectively to the two links of the device may be either in phase, or in phase opposition.

The invention also relates to a weaving loom of Jacquard type equipped with a shed forming device as described hereinbefore.

BRIEF DESCRIPTION OF THE DRAWINGS

The invention will be more readily understood on reading the following description of two forms of embodiment of a device and of a weaving loom in accordance with its principle, given solely by way of example and made with reference to the accompanying drawings, in which.

DESCRIPTION OF PREFERRED EMBODIMENTS

Figure 1:
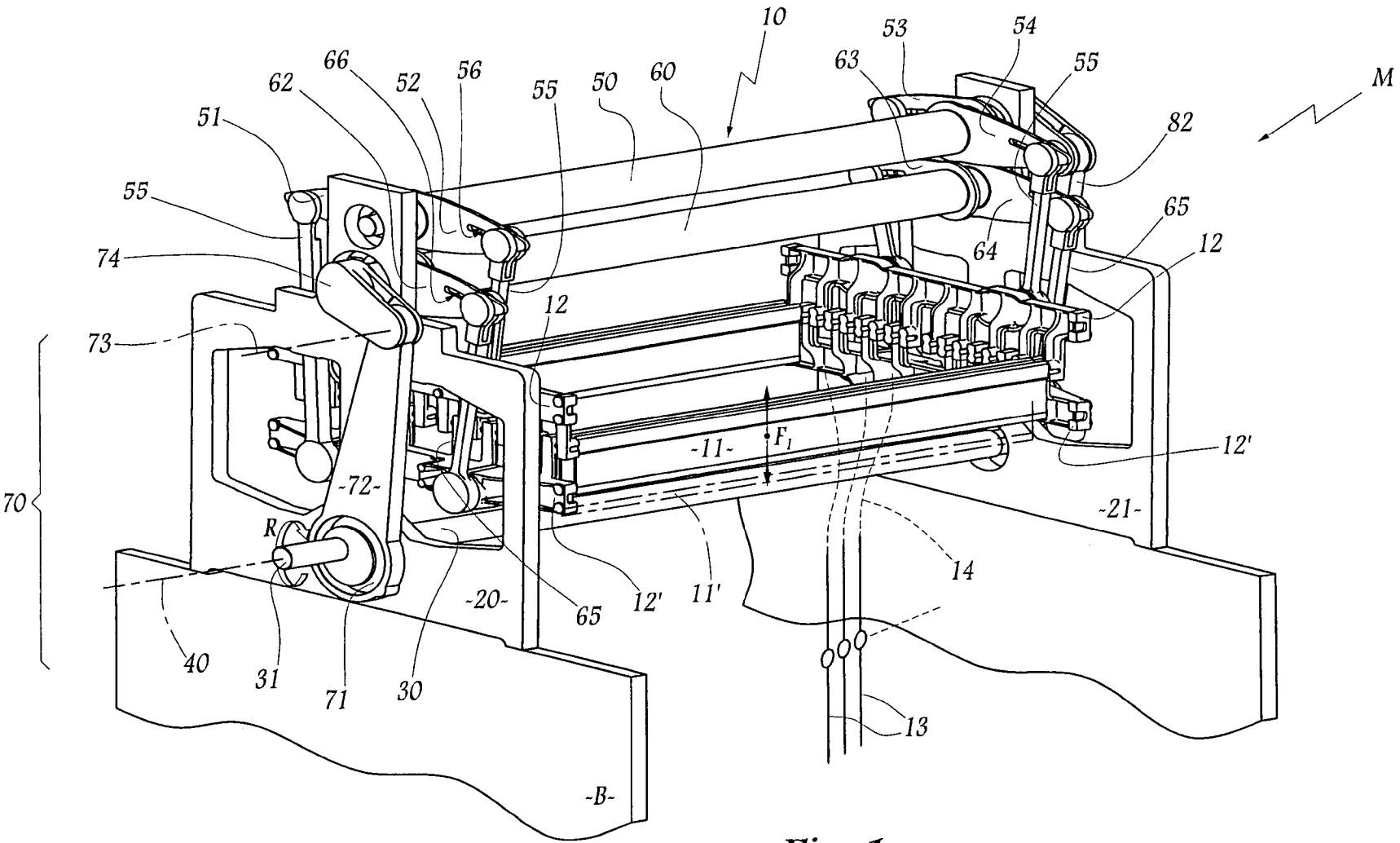
FIG. 1 is a view in perspective of a shed forming device according to the invention mounted on a weaving loom according to the invention.
Figure 2:
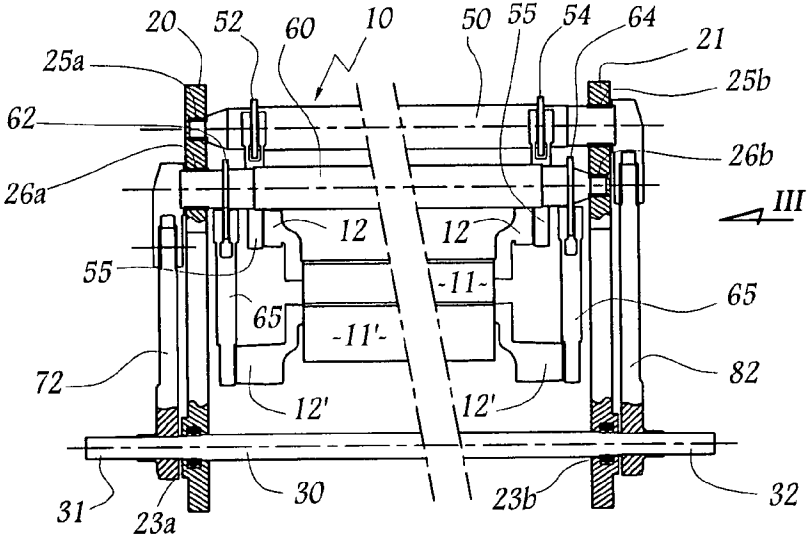
FIG. 2 schematically shows the device of FIG. 1 seen in side view and with parts torn away at the level of the bearings.

Referring now to the drawings, the weaving loom M shown very symbolically in FIG. 1 is equipped with a shed forming device 10 which comprises two series of knives or blades.

A first series of knives 11 is supported by two crosspieces 12 which form a first frame, while a second series of knives 11' is supported by two other crosspieces 12' which form a second frame.

The knives 11 and 11' are intended to be displaced with a vertical oscillatory movement represented by the double arrow $F_1$, this making it possible to displace hooks (not shown) between their respective top dead centre positions and bottom dead centre positions, in order to control the displacement of heddles 13 connected to a hook by harness cords 14 as is well known in the technical domain of Jacquard looms.

The crosspieces or frames 12 and 12' and the knives 11 and 11' associated therewith are arranged between two plates 20 and 21 intended to be connected to a frame B.

An input shaft 30 extends between the plates 20 and 21 and projects to the outside thereof. It is intended to be kinematically linked, at the level of one of its ends, with a drive shaft 40 represented solely by its axial line in FIG. 1. The shaft 30 is provided to be connected to the shaft 40 either at the level of its end 31 visible in FIG. 1 or of its opposite end 32, as desired, this making it possible to control the device 10 by one side or the other, as a function of the exact type of loom M or of the direction of assembly of the device 10 on the frame B.

Shaft 30 is animated by a movement of continuous rotation represented by arrow R.

Shaft 30 is supported by bearings 23*a* and 23*b* provided respectively on the plates 20 and 21, these bearings advantageously being constituted by simple lubricated rollers.

The device 10 also comprises two oscillating shafts, namely an upper oscillating shaft 50 and a lower oscillating shaft 60. These shafts are superposed, shaft 50 being disposed above shaft 60, and extend parallel to each other above the knives and crosspieces 11, 12, 11', 12' and through the plates 20 and 21 at the level of which they are supported by bearings 25*a* and 25*b* for shaft 50, 26*a* and 26*b* for shaft 60, respectively. These bearings may be of the same type as bearings 23*a* and 23*b*.

Shaft 50 is equipped with four rocking levers 51, 52, 53 and 54 connected to the crosspieces 12 and 12' by rods 55. Similarly, shaft 60 is equipped with four rocking levers, of which three are visible in FIG. 1 with references 62 to 64 and which are connected to the crosspieces 12 and 12' by rods 65.

The rocking levers 51, 62, 53 and 64 are connected to crosspieces 12', while the other rocking levers are connected to crosspieces 12.

A link 70 between shafts 30 and 60 is provided in the vicinity of the plate 20 outside the volume defined between the plates 20 and 21. This link comprises an eccentric 71 mounted on the shaft 30. A connecting rod 72 is mounted around the eccentric 71 and is articulated, about a pin 73, on a crank 74 forming fork joint fast with the end of the shaft 60 which projects beyond the plate 20.

This single link 70 makes it possible to convert the movement of continuous rotation of the shaft 30 into an oscillating movement for the shaft 60, without it being necessary to use cams or other mechanical devices necessitating very precise machinings and whose adjustment sometimes proves delicate.

The movement transmitted by the link 70 to the shaft 60 is itself transmitted to the rocking levers borne by this shaft, in the vicinity of the plate 20 but also in the vicinity of the plate 21, with the result that it is not necessary to provide a kinematic link between shafts 30 and 60 in the vicinity of this plate 21.

Furthermore, a link 80 of the same type as the link 70 is provided, between the shafts 30 and 50 and also comprises an eccentric 81 around which is mounted a connecting rod 82 articulated, about a pin 83, on a crank 84 fast with the shaft 50.

As previously, this link 80 makes it possible to transmit and convert the movement of continuous rotation of the shaft 30 up to the rocking levers 51 to 54.

Each of these rocking levers is equipped with a slot 56 or 66 making it possible to adjust the position of the rods 55 and 65 and, thereby, the shed obtained on the loom M.

The shafts 50 and 60 are identical or virtually identical, which enables savings to be made when manufacturing the device 10, the rocking levers equipping these shafts likewise being able to be identical.

Similarly, except for the connecting rods 72 and 82, the elements constituting the links 70 and 80 may be identical.

The plates 20 and 21 may be identical, since they are both traversed by each of the shafts 30, 50 and 60. This likewise enables savings to be made when mass-producing devices 10.

Figure 3:
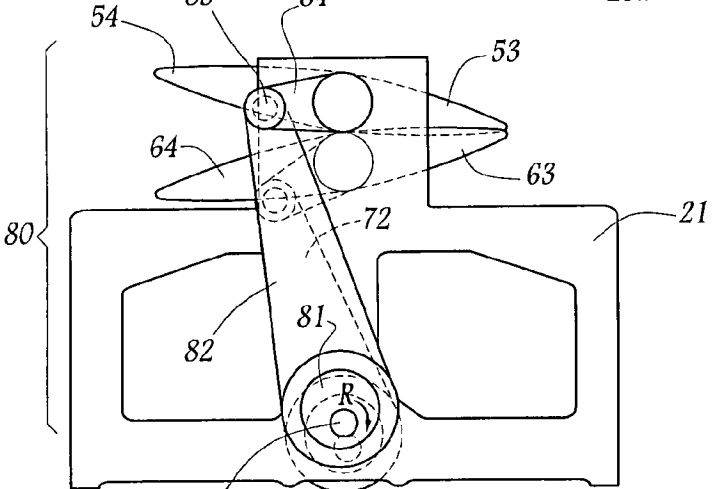
FIG. 3 is a view in the direction of arrow III in FIG. 2.

As is more particularly visible in FIG. 3, the connecting rods 72 and 82 of the links 70 and 80 are in phase.

Figure 4:
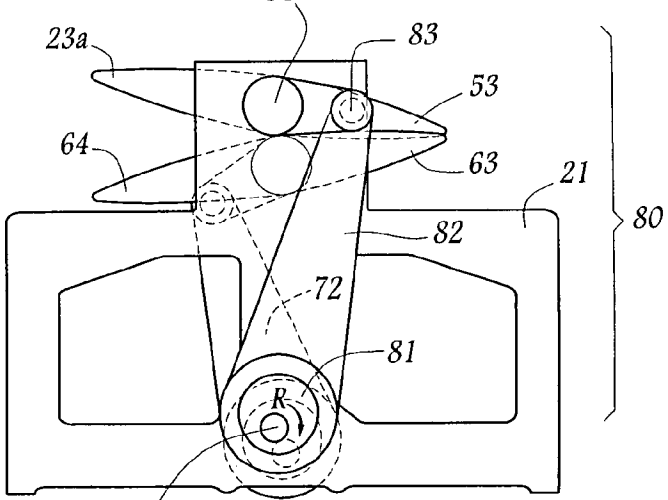
FIG. 4 is a view similar to FIG. 3 for a device in accordance with a second form of embodiment of the invention.

However, and as shown in FIG. 4, these connecting rods may be in phase opposition with respect to the shaft 30, this presenting the advantage of a better equilibrium of the device 10, leading to a limitation of the vibrations when the loom is operating.

The invention has been shown with knives 11 and 11' associated with crosspieces 12 and 12' in a relatively rigid structure. Of course, it is applicable to devices in which the knives are suspended from connecting rods.

What is claimed is:

1. Shed forming device for a weaving loom of Jacquard type in which the alternating vertical actuation of two series of knives is effected from a single input shaft animated by a continuous movement of rotation and extending between two plates which support oscillating shafts equipped with rocking levers kinematically connected to the series of knives, said input shaft being equipped, in the vicinity of each plate, with means for driving said rocking levers, wherein said oscillating shafts extend in parallel at least between said plates and are each connected to said input shaft by a single rod and eccentric link, a link being respectively made in the vicinity of each plate.

2. The device of claim 1, wherein said oscillating shafts are superposed above said series of knives.

3. The device of claim 1, wherein said oscillating shafts are substantially identical.

4. The device of claim 1, wherein said input shafts and oscillating shafts are supported by bearings mounted on said plates.

5. The device of claim 4, wherein said bearings are constituted by lubricated rollers.

6. The device of claim 1, wherein said plates are substantially identical.

7. The device of claim 1, wherein said input shaft is adapted to be connected to a drive shaft at the level of each of its ends.

8. The device of claim 1, wherein the connecting rods belonging respectively to said links are in phase.

9. The device of claim 1, wherein the connecting rods belonging respectively to said links are in phase opposition.

10. Weaving loom of Jacquard type equipped with a shed forming device of claim 1.

* * * * *